US010526097B2

(12) United States Patent
Lachenmeier et al.

(10) Patent No.: US 10,526,097 B2
(45) Date of Patent: Jan. 7, 2020

(54) REEFING UNDER STRETCH

(75) Inventors: Per Lachenmeier, Sonderborg (DK); Tonny Konstmann, Nordborg (DK)

(73) Assignee: Signode Industrial Group LLC, Glenview, IL (US)

( * ) Notice: Subject to any disclaimer, the term of this patent is extended or adjusted under 35 U.S.C. 154(b) by 753 days.

(21) Appl. No.: 14/114,918

(22) PCT Filed: May 7, 2012

(86) PCT No.: PCT/US2012/036725
§ 371 (c)(1),
(2), (4) Date: Jan. 24, 2014

(87) PCT Pub. No.: WO2012/154641
PCT Pub. Date: Nov. 15, 2012

(65) Prior Publication Data

US 2014/0137516 A1 May 22, 2014

(30) Foreign Application Priority Data

May 6, 2011 (DE) ..... 10 2011 075 451

(51) Int. Cl.
*B65B 9/14* (2006.01)
*B65B 9/13* (2006.01)

(52) U.S. Cl.
CPC ..... *B65B 9/14* (2013.01); *B65B 9/13* (2013.01); *B65B 9/135* (2013.01)

(58) Field of Classification Search
CPC ..... B65B 9/14; B65B 9/135; B65B 9/175; B65B 9/551; B65B 9/218
(Continued)

(56) References Cited

U.S. PATENT DOCUMENTS 2,711,803 A 6/1955 Hurst et al.
2,745,688 A 5/1956 Farrington et al.
(Continued)

FOREIGN PATENT DOCUMENTS

CN 101 830 292 9/2010
DE 2256753 5/1974
(Continued)

OTHER PUBLICATIONS

International Search Report and Written Opinion corresponding to PCT/US2012/036725, dated Sep. 14, 2012.
(Continued)

*Primary Examiner* — Gloria R Weeks
*Assistant Examiner* — Dariush Seif
(74) *Attorney, Agent, or Firm* — Neal, Gerber & Eisenberg LLP

(57) ABSTRACT

The present invention relates to a method for gathering-up a tubular film portion on at least two gathering fingers of a packaging machine and to a gathering apparatus of a packaging machine for carrying out the method as claimed in the invention. The method is distinguished in that the tubular film portion is expanded at least in a part region when being gathered-up onto the gathering fingers. The gathering apparatus as claimed in the invention is distinguished in that the gathering fingers can be driven into a gathering-up position for gathering-up the tubular film portion, in which gathering-up position the tubular film portion is expanded at least in a part region.

7 Claims, 3 Drawing Sheets

(58) Field of Classification Search
USPC ..... 53/441, 577
See application file for complete search history.

(56) References Cited

U.S. PATENT DOCUMENTS

| | | | | |
|---|---|---|---|---|
| 2,758,898 | A | 8/1956 | Kobsch | |
| 2,797,634 | A | 7/1957 | Rueckert | |
| 2,942,797 | A | 6/1960 | Lorenz et al. | |
| 3,016,869 | A | 1/1962 | Anderson et al. | |
| 3,190,457 | A | 6/1965 | Linden | |
| 3,278,059 | A | 10/1966 | Ridgeway et al. | |
| 3,436,046 | A | 4/1969 | Valeska | |
| 3,507,137 | A | 4/1970 | Taleff et al. | |
| 3,626,654 | A | 12/1971 | Hoffler et al. | |
| 3,679,244 | A | 7/1972 | Reddy | |
| 3,852,937 | A | 12/1974 | Bitsura et al. | |
| 3,902,303 | A * | 9/1975 | King | B65B 9/135 53/556 |
| 3,944,045 | A * | 3/1976 | Higgins | B65B 9/135 198/340 |
| 4,063,401 | A | 12/1977 | Higgins | |
| 4,067,174 | A | 1/1978 | Goldstein | |
| 4,204,377 | A | 5/1980 | Lancaster et al. | |
| 4,235,062 | A | 11/1980 | Lancaster, III et al. | |
| 4,317,322 | A | 3/1982 | Lancaster et al. | |
| 4,473,990 | A | 10/1984 | Thimon | |
| 4,587,796 | A | 5/1986 | Haloila | |
| 4,588,142 | A | 5/1986 | Malzacher | |
| 4,619,193 | A | 10/1986 | Crew | |
| 4,631,898 | A | 12/1986 | Brambilla | |
| 4,754,594 | A | 7/1988 | Lancaster | |
| 4,756,143 | A | 7/1988 | Lancaster | |
| 4,905,451 | A | 3/1990 | Jaconelli et al. | |
| 4,905,488 | A | 3/1990 | Plitt | |
| 4,914,891 | A | 4/1990 | Suolahti | |
| 4,939,989 | A | 7/1990 | Zacharias | |
| 5,107,657 | A | 4/1992 | Diehl et al. | |
| 5,140,795 | A | 8/1992 | Steding | |
| 5,154,382 | A | 10/1992 | Hoshino | |
| 5,195,297 | A | 3/1993 | Lancaster et al. | |
| 5,216,871 | A | 6/1993 | Hannen | |
| 5,463,843 | A | 11/1995 | Sharp | |
| 5,619,838 | A | 4/1997 | Kasel | |
| 5,623,808 | A | 4/1997 | Franklin et al. | |
| 6,032,439 | A * | 3/2000 | Birkenfeld | B65B 9/135 53/441 |
| 6,237,307 | B1 | 5/2001 | Zentmyer et al. | |
| 6,298,636 | B1 * | 10/2001 | Lachenmeier | B65B 9/135 53/442 |
| 6,470,654 | B1 | 10/2002 | Lachenmeier et al. | |
| 6,516,591 | B1 | 2/2003 | Lancaster, III et al. | |
| 6,539,690 | B2 | 4/2003 | Alvarez | |
| 6,619,872 | B2 | 9/2003 | Crorey et al. | |
| 6,622,620 | B1 | 9/2003 | Byington | |
| 6,865,865 | B2 * | 3/2005 | Hannen | B65B 9/135 53/567 |
| 6,945,163 | B2 | 9/2005 | Squyres | |
| 7,036,289 | B2 | 5/2006 | Suolahti | |
| 7,040,076 | B2 | 5/2006 | Lachenmeier et al. | |
| 7,234,289 | B2 * | 6/2007 | Hannen | B65B 9/15 53/441 |
| 7,325,487 | B2 | 2/2008 | Squyres | |
| 7,367,740 | B2 | 5/2008 | Lazic et al. | |
| 7,533,515 | B1 | 5/2009 | Koskela | |
| 7,707,801 | B2 | 5/2010 | Lancaster, III | |
| 7,707,802 | B2 | 5/2010 | Forrest | |
| 7,908,831 | B1 | 3/2011 | Dugan | |
| 7,913,476 | B2 | 3/2011 | Lachenmeier | |
| 7,937,910 | B2 | 5/2011 | Jaconelli et al. | |
| 7,966,790 | B2 | 6/2011 | Michels et al. | |
| 7,975,456 | B2 | 7/2011 | Lachenmeier et al. | |
| 8,141,327 | B2 | 3/2012 | Lancaster, III | |
| 8,347,784 | B2 | 1/2013 | Herrmann | |
| 8,453,420 | B2 | 6/2013 | Schmidt et al. | |
| 8,875,480 | B2 * | 11/2014 | Czok | B65B 9/135 53/209 |
| 2001/0046409 | A1 | 11/2001 | Fischer | |
| 2002/0033005 | A1 * | 3/2002 | Lachenmeier | B65B 9/135 53/459 |
| 2003/0156891 | A1 | 8/2003 | Hung et al. | |
| 2004/0107677 | A1 * | 6/2004 | Hannen | B65B 9/135 53/459 |
| 2006/0005511 | A1 | 1/2006 | Suolahti et al. | |
| 2006/0040085 | A1 | 2/2006 | Downs et al. | |
| 2006/0285915 | A1 | 12/2006 | Dellach et al. | |
| 2007/0157557 | A1 | 7/2007 | Lancaster, III | |
| 2007/0163207 | A1 | 7/2007 | Chiu Chen | |
| 2009/0217624 | A1 | 9/2009 | Forrest | |
| 2009/0229226 | A1 | 9/2009 | Beeland et al. | |
| 2009/0293425 | A1 | 12/2009 | Carter et al. | |
| 2010/0018165 | A1 | 1/2010 | Kudia | |
| 2010/0071317 | A1 * | 3/2010 | Michels | B65B 9/135 53/441 |
| 2010/0163443 | A1 | 7/2010 | Storig et al. | |
| 2010/0258241 | A1 | 10/2010 | Perecman | |
| 2011/0258973 | A1 * | 10/2011 | Czok | B65B 9/135 53/473 |
| 2014/0013714 | A1 | 1/2014 | Lachenmeier et al. | |
| 2014/0053502 | A1 | 2/2014 | Pecchenini et al. | |

FOREIGN PATENT DOCUMENTS

| | | | | |
|---|---|---|---|---|
| DE | 3101310 | | 12/1981 | |
| DE | 3918311 | A1 * | 12/1989 | B65B 9/135 |
| DE | 3914595 | | 11/1990 | |
| DE | 20101909 | | 6/2002 | |
| DE | 10 2005 037 916 | | 5/2006 | |
| DE | 102005062609 | A1 * | 7/2007 | B65B 9/135 |
| DE | 20 2007 018 900 | | 8/2009 | |
| DE | 10 2010 037 770 | | 6/2012 | |
| DE | 102011000205 | A1 * | 7/2012 | B65B 9/18 |
| DE | 102012024176 | A1 * | 6/2014 | B65B 9/135 |
| EP | 0 621 184 | | 10/1994 | |
| EP | 0 653 352 | | 5/1995 | |
| EP | 0 811 554 | | 12/1997 | |
| EP | 1 033 305 | | 9/2000 | |
| EP | 1 097 867 | | 5/2001 | |
| EP | 1266828 | A1 * | 12/2002 | B65B 9/135 |
| EP | 1266829 | A1 | 12/2002 | |
| EP | 1 454 827 | | 9/2004 | |
| EP | 1 542 192 | | 6/2005 | |
| EP | 1574432 | A1 * | 9/2005 | B65B 9/135 |
| EP | 2 060 492 | | 5/2009 | |
| EP | 2 069 209 | | 6/2009 | |
| EP | 2 199 214 | | 6/2010 | |
| EP | 2 792 599 | | 10/2014 | |
| FI | 78433 | | 4/1989 | |
| FI | 91624 | | 4/1994 | |
| FR | 1 396 355 | | 4/1965 | |
| GB | 2 395 165 | | 5/2004 | |
| JP | 2002104308 | | 4/2002 | |
| JP | 2013154956 | | 8/2013 | |
| WO | 02/812065 | | 2/2002 | |
| WO | 2004/045952 | | 6/2004 | |
| WO | 2006/110596 | | 10/2006 | |
| WO | 2008/031449 | | 3/2008 | |
| WO | 2010/078915 | | 7/2010 | |
| WO | 2012/027705 | | 3/2012 | |

OTHER PUBLICATIONS

Extended European Search Report dated Jan. 21, 2016 for European Application No. 15185203.5 (6 pages).

* cited by examiner

REEFING UNDER STRETCH

RELATED APPLICATIONS

The present application is a National Phase of International Application Number PCT/US2012/036725, filed May 7, 2012, and claims priority from German Application Number 102011075451.2, filed May 6, 2011.

The present invention relates to a method for gathering-up a tubular film portion onto the gathering fingers of a packaging machine and to an apparatus for carrying out the method as claimed in the invention.

These types of apparatuses and methods are known from the prior art and are generally used for the purposes of wrapping up a product, which is arranged for the most part on a pallet, at least in part with a tubular film in a packaging machine. This serves, on the one hand, to package the product, on the other hand, also to secure the load and to provide protection against the weather. The tubular film, in this connection, can be realized both as a hood that is closed at the top or as a band that is open at the top and the bottom.

In order to wrap the products, first of all a tubular film portion which is matched to the product is unrolled at least in part from a roll in the usual manner. The gathering fingers which are fastened to a frame—as a rule four gathering fingers are used—are then introduced into the open end of the tubular film portion from below. Obviously machines with more than or fewer than four gathering fingers can also be used.

A gathering drive unit is then moved into contact with the tubular film portion such that an operative connection is created. In the majority of cases, a gathering roller associated with the respective gathering finger, an endless belt or the like are used as a gathering drive unit, the drive being effected, for example, by means of an electric motor.

By driving the gathering roller, the tubular film portion is gathered-up onto the individual gathering fingers such that a film store laid in folds is formed on the respective gathering finger. This step is essential to the quality of the wrapping as an unwanted or erroneous crease when ungathering the film can result in weak points in the film. In the worst case, these weak points can tear or begin to break such that the wrapped product is no longer fixed securely on the pallet. In addition, moisture, dirt or the like could also reach the product in this way.

Once the tubular film portion has been gathered-up, the gathering fingers are driven in a substantially horizontal manner such that the tubular film portion is expanded or stretched. Expanding or stretching refers to a state where an elastic or elastic-plastic deforming of the tubular film occurs. In other words, the tubular film is no longer in the slack state and the size of the film is more than 100% with reference to the slack state. These types of percentage specifications below refer to the size of the tubular film in the slack state.

The gathering fingers are then driven in a vertical manner along the product. At the same time the tubular film is ungathered from the gathering finger and the product is wrapped up therein as a result of the elastic resiliency of the tubular film portion.

In order to minimize the abovementioned problems which can be caused by the gathering-up of the tubular film portion, it has proved worthwhile to choose the gathering-up position of the gathering fingers such that the tubular film portion is pulled slackly over the gathering fingers. The position of the gathering fingers, therefore, is such that the extent is less than 100% of the size of the tube in the slack state. In addition, the gathering fingers usually also have a fixed contact means—in the majority of cases a contact roller for the gathering roller of the gathering drive—, the axis of rotation of which is situated inside the gathering finger. The operative connection with the gathering roller during the gathering-up process is then formed in the region of said contact roller. Consequently during the gathering-up process there is an inclinedly vertical and extensively parallel fold formation with the formed film store expanding in a substantially vertical manner. Said fold formation makes it possible to ungather the tubular film portion in a relatively regular manner from the gathering finger.

However, in the case of the known methods or apparatuses, folds, which are already present in the frequently slightly tacky delivery state of the film or in the unfolded, substantially tension-free state before the tubular film is gathered-up, are transferred directly into the subsequent film store. These irregularly occurring folds can also result in the above-described problems. In this respect, there is a desire to increase the quality of the wrapping over and above the known level which is itself already very high.

Consequently, the object underlying the invention is to improve the gathering-up of a tubular film portion such that the quality of the wrapping of the product is improved overall.

The object is achieved with a method as claimed in claim 1 and an apparatus as claimed in claim 7. Advantageous further developments of the invention are described in the subclaims.

The method as claimed in the invention for gathering-up a tubular film portion on at least two gathering fingers, preferably on four gathering fingers, of a packaging machine is distinguished in relation to the method already depicted in that the tubular film portion is expanded at least in a part region when being gathered-up onto the gathering fingers. The tubular film portion is therefore partially stretched during the gathering-up process, i.e. the size is expanded to in excess of 100% of the original size of the tube in the still slack state. The advantage of this is that as a result of the at least short-term or partially elastic or elastic-plastic deforming of the tubular film portion, the folds in the tubular film portion resulting from the production process are removed. Consequently the creation of weak points when ungathering the tubular film portion can be prevented. This increases the quality of the wrapping of the product.

In an expedient manner, the tubular film portion is expanded in the region of a contact means of the respective gathering finger. The advantage of the expanding in the region of the contact means is that the tubular film portion is only stressed in a locally clearly defined manner during the expanding process such that the tubular film portion is able to slacken again in other regions of the gathering finger.

It is advantageous when the position of at least part of the contact means on the gathering finger is modified at least in the horizontal and/or vertical direction, in particular in dependence on the progress of the gathering process. Consequently, the expanding of the tubular film portion is able to be modified during the gathering-up process and in particular is able to be adapted to the size of the gathered-up tubular film portion.

In addition, it is advantageous when the tubular film portion is expanded in the entire contact region of the tubular film portion on the gathering finger. The advantage of this is that the space available as contact region on the gathering finger is utilized in an optimum manner to form the film store.

In an expedient manner, the contact means on the gathering finger is moved into a position where a substantially vertical crease is formed in the gathered-up tubular film portion. In addition, it is expedient when the contact means on the gathering finger is moved into a position where the gathered-up tubular film portion extends substantially in a horizontal direction from the gathering finger. The tubular film portion, therefore, is not pushed downward in a vertical direction during the gathering-up process. Consequently, the gathered-up tubular film portion or the film store can be formed in a space-saving manner on the contact region of the gathering finger.

Regarding the apparatus, the object is achieved with a gathering apparatus of a packaging machine as claimed in claim 7. The gathering apparatus, therefore, has at least two gathering fingers and one gathering drive unit for gathering-up the tubular film portion. The gathering apparatus as claimed in the invention is distinguished in relation to the known gathering apparatuses from the prior art in that the gathering fingers are driven into a gathering-up position for gathering-up the tubular film portion, in which gathering-up position the tubular film portion is expanded at least in a part region. Compared to the gathering-up position known from the prior art, consequently the tubular film portion is partially expanded or stretched during the gathering-up process, as a result of which folds which are caused by the production process or are created when the tubular film portion is unfolded are removed. Weak points which can occur in the tubular film portion during the ungathering process are avoided in this way and the quality of the wrapping increases.

In an expedient manner, the gathering apparatus is developed such that the tubular film portion is expanded on a contact means arranged on the respective gathering finger only in the contact region of the tubular film portion when the gathering fingers are moved into the gathering-up position. The expanding of the tubular film portion is therefore only effected in a defined region, as a result of which stressing the tubular film portion over a large-area is avoided. This also enables the tubular film to be slackened below the contact region on the contact means, which depending on the circumstance results in more regularly layered fold formation.

It has certainly been shown that it is also advantageous when the apparatus is realized so that the gathering fingers are drivable into a position in which the tubular film portion is expanded in the entire contact region of the tubular film portion on the gathering finger. In contrast to the gathering-up positions known from the prior art where the tubular film portion is slack or slackened, as claimed in the invention the gathered-up tubular film portion then lies flat against the gathering finger closely below the contact means. Consequently, the space available in the contact region of the gathering finger is clearly utilized in a better manner than up to now. This enables a lower installation height of the gathering finger compared to the gathering fingers known from the prior art. Consequently, the installation height of the entire packaging machine can also be reduced.

In an expedient manner, the contact means has at least one contact roller, one endless belt or the like, which, in a preferred manner, is or are movable into operative connection with the gathering drive unit.

In a further development the position of at least part of the contact means on the gathering finger is modifiable at least in the horizontal and/or vertical direction, in particular in dependence on the progress of the gathering process. Consequently, the position of the contact means is able to be adapted to the size of the already formed film store. This enables a particularly regular fold formation in the gathered-up tubular film portion. In this case it is conceivable for corresponding, for example optical monitoring means to detect the progress of the gathering process and to enable targeted control of the contact means. It is also conceivable for the gathering fingers themselves to be driven in dependence on the progress of the gathering process.

In an expedient manner the axis of rotation of the contact means is arranged outside the contact region of the tubular film portion on the gathering finger. Consequently the gathering finger can be driven into a gathering-up position in which the tubular film portion is expanded in a sufficient manner in the region of the contact means in order to remove folds caused during the production process from the tubular film portion.

It is advantageous when at least 50%, in a preferred manner at least 60%, of the side surface of a contact roller of the contact means protrudes from the gathering finger when viewed from the side. It is also conceivable for an entire contact roller or the entire contact means to protrude from the gathering finger. The advantage of this is that during the ungathering process the gathering finger can be moved closer to the product to be wrapped, which increases the quality of the wrapping as the spacing between the gathering fingers or the film store and the product is smaller.

In an expedient manner a movable supporting means is provided on the gathering finger, the position of which is modifiable in particular in dependence on the progress of the gathering process. The supporting means can be, for example, a supporting table which can be driven both in a vertical manner and in a horizontal manner. The film store can consequently be located on the supporting means. This allows adaptation to the most varied of products to be wrapped even during the gathering-up operation.

The invention is to be explained in more detail below by way of further exemplary embodiments shown in the drawing, in which in a schematic manner:

Figure 1:
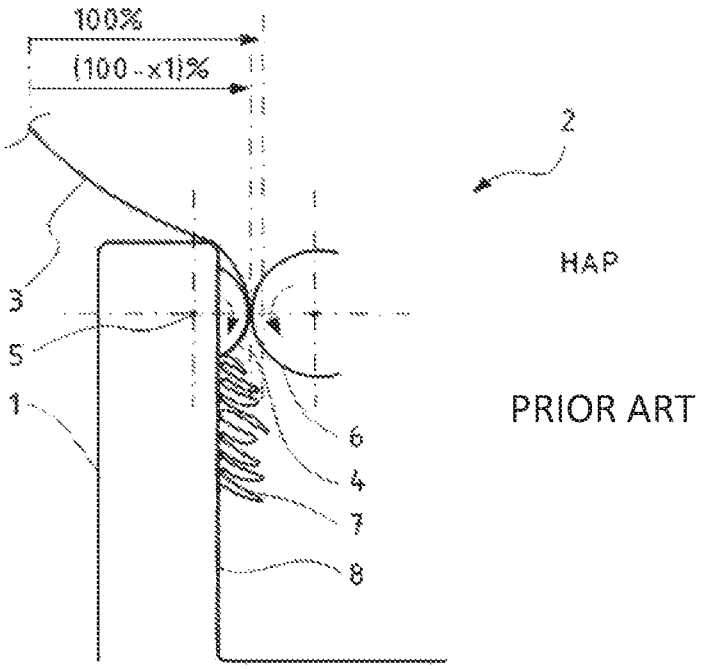
FIG. 1 shows a known gathering finger in a gathering-up position known from the prior art.

FIGS. 1 to 5 show, in each case in the manner of cutouts, the side view of a gathering finger 1 of a gathering apparatus 2 of a packaging machine which is used to gather a tubular portion film 3. Four gathering apparatuses 2, which are arranged in the corners of a rectangular frame and each have one gathering finger 1, are used in a typical manner in the case of a packaging machine, as is also shown in FIG. 6.

As contact means, the gathering finger 1 has a contact roller 4 which is mounted at its upper end with an axis of rotation 5. The contact roller 4 can be moved into operative connection with a gathering roller 6 of a gathering drive unit and thus encloses the tubular film portion 3. The gathering drive unit can have an electric motor, for example, to drive the gathering roller 6. Said electric motor drives each of the gathering rollers 6 in such a manner that the tubular film portion 3 is gathered-up onto the gathering finger 1, as indicated by the movement arrows of the contact roller 4 and gathering roller 6. Consequently, the tubular film portion is gathered-up in the manner of a film store 7 in the contact region 8 of the gathering finger 1.

FIG. 1 shows a gathering finger 1 of a gathering apparatus 2, which is known per se from the prior art, in a conventional gathering-up position HAP. The axis of rotation 5 of the contact roller 4 is arranged as usual inside the gathering finger 1 such that the largest part of the contact roller 4 is inside the gathering finger 1.

The gathering finger 1 shown in FIG. 1 is located as mentioned in a conventional gathering-up position in which the tubular film portion 3 is not expanded, that is to say is slack. This is also indicated by the size specification (100–x1)%. For example, the relative value for x1 can amount to between 2% and 5% or more. This means that the tubular film portion, which is unfolded by the driving of the gathering fingers 1 into the usual gathering-up position, is not yet fully unfolded. Rather, on account of the adhesive effect of the film in the delivery state, it has a size which could amount to approximately between 95% and 98% of the actual size of the tubular film portion 3.

During the gathering-up process a film store 7 is now created in the known manner, said film store extending in the vertical direction along the contact region 8. It has an irregular fold formation which is substantially inclinedly vertical. Using the gathering finger 1 shown in FIG. 1 along with the gathering-up position HAP shown, vertically aligned folds in the tubular film portion 3 can, however, be incorporated as far as into the tubular film store, which can lead to the mentioned difficulties when the film is ungathered.

Figure 2:
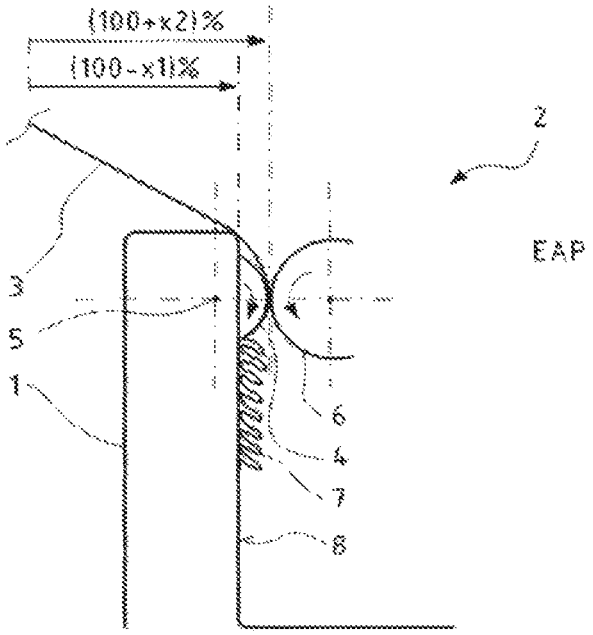
FIG. 2 shows a first exemplary embodiment of the invention using a conventional gathering finger in a gathering-up position as claimed in the invention.

FIG. 2 shows the gathering finger 1 represented in FIG. 1 once again. However the gathering finger 1 is situated in a gathering-up position EAP as claimed in the invention, in which gathering-up position the tubular film portion 3 is expanded in the region between the contact roller 4 and the gathering roller 5 by the relative size difference x2 (for example between 3% and 5%). As a result of the expanding of the tubular film portion 3 in the region of the contact roller 4, almost all the folds caused by the production process are removed from the tubular film portion 3.

Figure 3:
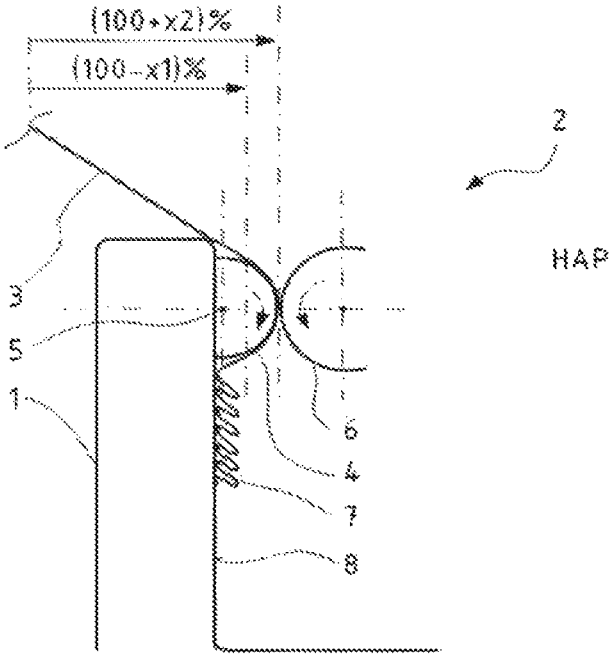
FIG. 3 shows a second exemplary embodiment of the invention using a first variant of a gathering finger modified as claimed in the invention in a first gathering-up position as claimed in the invention.

FIG. 3 shows a second exemplary embodiment of the invention with a first variant of a gathering finger 1 modified as claimed in the invention where the axis of rotation 5 of the contact roller 4 is arranged outside the contact region 8 of the gathering finger 1. The gathering finger 1 is situated in the identical gathering-up position HAP as the gathering finger 1 shown in FIG. 1. In contrast to this, the tubular film portion 3, however, is expanded in the region between the contact roller 4 and the gathering roller 5, as is indicated by the size specification (100+x2)%. For example, the tubular film portion 3 is expanded by approximately between 3% and 5% such that its size in this region would be enlarged to between 103% and 105% of its size when produced. As a consequence, there is the identical effect here as in the case of the gathering finger 1 shown in FIG. 2, namely the removal of folds in the tubular film portion 3 produced during the production process.

Figure 4:
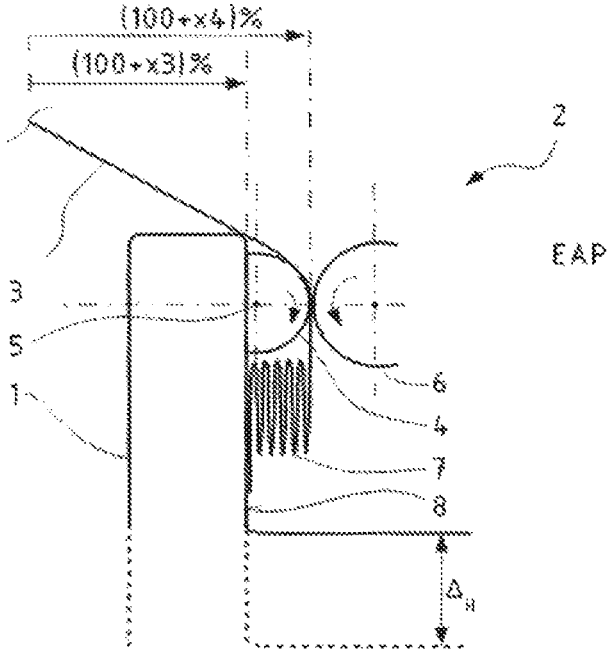
FIG. 4 shows a third exemplary embodiment of the invention using a second variant of a gathering finger modified as claimed in the invention with a shortened installation height in a second gathering-up position as claimed in the invention.

FIG. 4 shows a third exemplary embodiment of the invention using a second variant of a gathering finger 1 as claimed in the invention. This latter corresponds substantially to the gathering finger 1 shown in FIG. 3, but has a smaller installation height than the gathering finger 1 shown in FIG. 3. The gathering finger 1 is situated here too in a gathering-up position EAP which is modified as claimed in the invention. The tubular film portion 3 is consequently expanded over the entire contact region 8 by the relative size difference x3, it could be possible for x3, for example, to be within the region of between 3% and 20% or even more. In addition, the tubular film portion 3 is expanded in the region of the contact roller 4 by the relative size difference x4, which, for example, could be in the region of in excess of 5%. Consequently, folds caused in the production process are removed from the tubular film portion 3 during the gathering-up process.

The combination of the modified gathering-up position and the modified gathering finger 1 shown in FIG. 4 results in it being possible to create a film store 7 which has a substantially vertical fold formation and which extends substantially in the horizontal direction away from the contact region 8. This means that it is possible to realize a smaller installation height of the gathering finger 1 than up to now as the film store 7 grows widthwise and no longer downward as usual up to now. To elucidate the effect, the finger shown in FIG. 1 is also shown in FIG. 4, however by a broken line. It is clear to see that the installation height of the gathering finger 1 differs by the amount $\Delta_H$.

Figure 5:
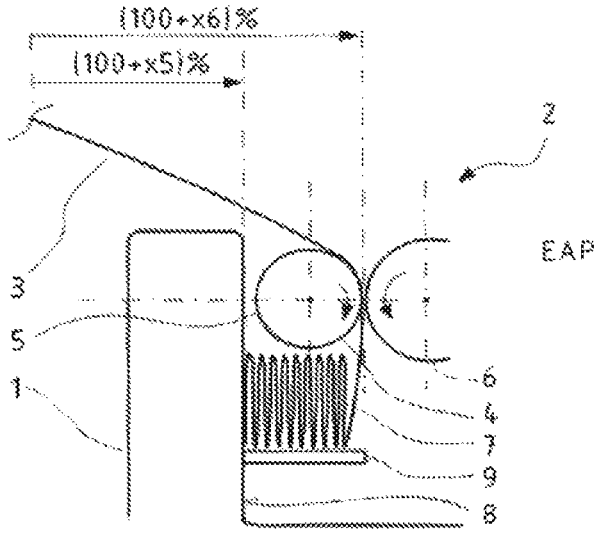
FIG. 5 shows a fourth exemplary embodiment of the invention using a third variant of a gathering finger modified as claimed in the invention with a supporting means.
Figure 6:
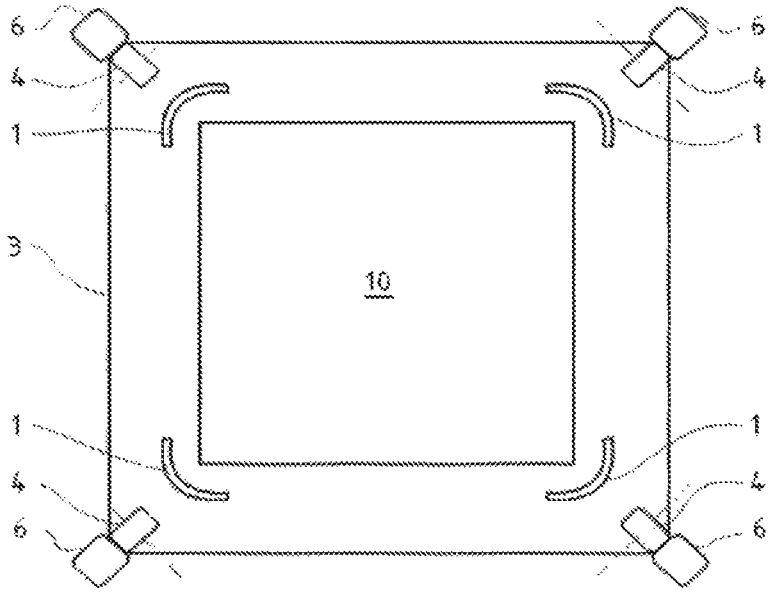
FIG. 6 shows a top view of a packaging machine with the gathering fingers shown in FIG. 5.

FIG. 5 shows a fourth exemplary embodiment of the invention using a third variant of the gathering finger 1 as claimed in the invention. The gathering finger 1 differs from the gathering finger 1 shown in FIG. 4 in that the contact roller 4 is arranged completely outside the gathering finger 1, or has been moved out from the same. In addition, the gathering finger 1 has a supporting means 9 on which the film store 7 is supported in the vertical direction. The supporting means 9 can be moved in the horizontal and vertical direction in order, in this manner, to enable adaptation during the gathering-up process to the various products to be wrapped. In the representation according to FIG. 5, the tubular film portion 3 is expanded in the entire contact region 8 by the relative size difference x5, and in the region of the contact roller 4 by the relative size difference x6, it could be possible for x5 and x6 to be within the range of, for example, between 3% and 20% or more.

FIG. 6 shows a top view of a packaging machine for wrapping a product 10, said wrapping machine having four gathering fingers 1 as claimed in the invention and as are shown in FIG. 5. As the figure clearly shows, it is possible to move the gathering fingers relatively close to the product 10.

In general it is also conceivable for the gathering finger 1 to be moved in dependence on the progress of the gathering process in such a manner that the relative size difference continuously increases. In addition, it is conceivable for the position of the contact roller 4 on the gathering finger 1 to be modified in dependence on the progress of the gathering process at least in the horizontal but also in the vertical direction. As a consequence, a continuous increase in the relative size difference is achieved. Consequently, it is possible to control the crease or the horizontal extent of the film store 7.

LIST OF REFERENCES

1 Gathering finger
2 Gathering apparatus
3 Tubular film portion

4 Contact roller/contact means
5 Axis of rotation of the contact roller
6 Gathering roller
7 Film store
8 Contact region
9 Supporting means
10 Product
HAP Conventional gathering-up position
EAP Gathering-up position as claimed in the invention
x1-x6 Relative size difference
$\Delta_H$ Installation height difference

The invention claimed is:

1. A method for operating a wrapping machine, the method comprising:

operatively connecting a first contact roller of a first gathering finger with a first gathering roller to hold a first portion of tubular film therebetween;

operatively connecting a second contact roller of a second gathering finger with a second gathering roller to hold a second portion of the tubular film therebetween;

afterwards, maintaining the first and second gathering fingers in a gathering configuration while driving the first and second gathering rollers to gather the tubular film onto the first and second gathering fingers such that the tubular film stretches to a second perimeter length greater than a first unstretched perimeter length when driven over the first and second contact rollers and, after being driven over the first and second contact rollers, contracts onto the first and second gathering fingers to a third perimeter length and forms folds along the first and second gathering fingers; and after gathering the tubular film onto the first and second gathering fingers, moving the first and second gathering fingers laterally outward relative to one another into a wrapping configuration to stretch the tubular film to a fourth perimeter length.

2. The method of claim 1, wherein the first and second gathering fingers are laterally spaced apart a designated distance while in the gathering configuration and while the tubular film is being gathered onto the first and second gathering fingers.

3. The method of claim 1, wherein the third perimeter length is between the first and second perimeter lengths.

4. The method of claim 1, wherein a first axis of rotation of the first gathering roller and a second axis of rotation of the first contact roller are not vertically offset from one another.

5. The method of claim 1, wherein a first axis of rotation of the first gathering roller and a second axis of rotation of the first contact roller are in a horizontal plane, and wherein the horizontal plane is perpendicular to a third axis of the first gathering finger.

6. The method of claim 1, further comprising, after moving the first and second gathering fingers into the wrapping configuration, moving the first and second gathering fingers vertically relative to an object while driving the first and second gathering rollers to discharge the tubular film from the first and second gathering fingers such that the tubular film contracts onto the object.

7. A method for wrapping an object with tubular film having an unstretched perimeter length, the method comprising:

maintaining a plurality of gathering fingers in a gathering configuration while driving a plurality of gathering rollers to gather the tubular film onto the plurality of gathering fingers such that the tubular film stretches to a perimeter length greater than the unstretched perimeter length;

afterwards, moving the plurality of gathering fingers laterally outward relative to one another into a wrapping configuration to stretch the tubular film to a perimeter length sufficient to wrap the object; and with the plurality of gathering fingers in the wrapping configuration, vertically moving the plurality of gathering fingers while driving the plurality of gathering rollers to discharge the tubular film from the plurality of gathering fingers such that the tubular film contracts onto the object.

* * * * *